United States Patent [19]

Emmenthal et al.

[11] 4,363,308

[45] Dec. 14, 1982

[54] FUEL INJECTION APPARATUS

[75] Inventors: Klaus-Dieter Emmenthal; Otto Schäfer, both of Wolfsburg; Rudolf-Helmut Strozyk, Helmstedt, all of Fed. Rep. of Germany

[73] Assignee: Volkswagenwerk Aktiengesellschaft, Wolfsburg, Fed. Rep. of Germany

[21] Appl. No.: 146,201

[22] Filed: May 5, 1980

Related U.S. Application Data

[62] Division of Ser. No. 942,416, Sep. 14, 1978, Pat. No. 4,224,915.

[30] Foreign Application Priority Data

Apr. 19, 1978 [DE] Fed. Rep. of Germany ..... 2817049

[51] Int. Cl.[3] ..... F02M 39/00

[52] U.S. Cl. ..... 123/533; 261/23 A; 261/50 A; 123/179 G

[58] Field of Search ..... 123/531, 533, 179 G, 123/179 L; 261/23 A, 50 A

[56] References Cited

U.S. PATENT DOCUMENTS

| | | | |
|---|---|---|---|
| 3,404,667 | 10/1968 | Mennesson | 123/445 |
| 3,437,081 | 4/1969 | Mennesson | 123/445 |
| 4,246,879 | 1/1981 | Fiala | 123/533 |

*Primary Examiner*—Charles J. Myhre
*Assistant Examiner*—E. Rollins Cross
*Attorney, Agent, or Firm*—Brumbaugh, Graves, Donohue & Raymond

[57] ABSTRACT

Apparatus for injecting fuel into the intake pipes of an internal combustion engine. The apparatus has an air channel branching off from the intake line at a point ahead of an adjustable throttle flap; a fuel metering device supplying fuel to the air channel in dependence upon engine load; and a fuel delivery pump arranged to receive a fuel-air mixture from the air channel through a narrowed constriction. The fuel pump passes the fuel-air mixture, with additional air which may be supplied thereto, to a fuel distributor which directs the mixture to the individual intake pipes of the engine.

9 Claims, 12 Drawing Figures

60
61
62
63
64
65
66
67
68
69
70
71
73
74
75
76
77
78
79
80
81
82
83
84
86
87
88
89
90
91
92
93
94
95
96
97

FUEL INJECTION APPARATUS

This is a division, of application Ser. No. 942,416, filed Sept. 14, 1978, now U.S. Pat. No. 4,224,915.

BACKGROUND OF THE INVENTION

The present invention relates to a system for injecting fuel into the intake pipes of an internal combustion engine. The system has an air channel branching off from the intake line of the engine ahead of an arbitrarily adjustable throttle flap. A fuel metering device supplies fuel to the air channel in accordance with the engine requirements. A fuel delivery pump receives the fuel and air through a constriction or narrowed cross-section in the channel and passes a fuel-air mixture, via a fuel distributor, to the individual intake pipes of the engine.

A fuel injection system of this type is disclosed in the commonly-owned U.S. patent application Ser. No. 932,493, filed Aug. 10, 1978, of Klaus Emmenthal et al. entitled "FUEL INJECTION APPARATUS". This system is an improvement over the fuel injection system disclosed in the West German Pat. No. 1,243,917. The essential difference between the system in accordance with the U.S. patent application and system disclosed in the German patent is that in the improved system the fuel delivery pump supplies air as well as fuel even under conditions of maximum engine load, whereas in the system disclosed in the patent the pump is designed to deliver substantially pure fuel under conditions of maximum engine load. Only when the engine is operating under conditions of less than maximum power does the fuel pump deliver a mixture of air and fuel.

With a fuel injection system of the type disclosed in the West German Pat. No. 1,243,917 there are therefore operating conditions of the internal combustion engine in which the fuel pump delivers relatively little air. In this case, there is a danger that fuel and air are not delivered continuously but, rather, that "air pockets" are formed which are forwarded to the fuel distributor following the fuel pump. These air pockets are not removed through mixture formation in the distributor so that, as a result, practically pure air is supplied to some of the engine cylinders during some of the piston strokes.

With the design of the fuel delivery pump in accordance with the improvement disclosed in the aforementioned patent application, air is passed through the pump even under conditions of maximum engine output so that the proper mixture formation is ensured. In particular, the fuel is "prepared" already at the fuel pump and also, in any event, as it passes through the comparatively long line or tube between the fuel pump and the fuel distributor. Ideally, the quantity of the auxiliary air in relation to the quantity of fuel is sufficiently large that a film of fuel is deposited on the walls of the fuel line between the pump and the distributor and is rapidly transported by the auxiliary air. This rapid transport is of special importance in the case of engine load fluctuations because the fuel supplied to the engine must be quickly responsive to the load conditions. Accordingly, a homogeneous fuel-air mixture is supplied via the distributor to the intake pipes of the engine. This mixture is extremely rich, however, so that pure air must still be delivered through the intake pipes to the cylinders for proper combustion.

In a fuel injection system of the type disclosed in the aforementioned U.S. patent application a very large fuel delivery pump is required to pump auxiliary air of sufficient quantity, relative to the fuel quantity, that no air pockets occur in the line leading from the fuel pump to the distributor. Particularly in cases of high-power engines, the size of the fuel delivery pump must be very large indeed, although at small and normal loads only a small proportion of the pump capacity is utilized.

SUMMARY OF THE INVENTION

An object of the present invention is to provide a fuel injection system of the type described above which does not require a fuel delivery pump of large dimensions.

This object, as well as other objects which will become apparent from the discussion that follows, are achieved, according to the present invention, by supplying auxiliary air at the outlet of the fuel pump for forming the fuel-air mixture to be supplied to the distributor. Conveniently, the auxiliary air is supplied by means of an air pressure generator and a bypass line connecting the air pressure generator to the fuel pump outlet in the immediate vicinity of the fuel pump.

By supplying a large quantity of auxiliary air directly at the outlet of the fuel delivery pump, the pump must be dimensioned only for conveying the fuel required for maximum loads of the engine plus only a comparatively small volume of additional auxiliary air. It is important, in this regard, that this large quantity of auxiliary air be supplied as close as possible to the outlet of the fuel pump so that, if possible, the entire length of the fuel line between the fuel delivery pump, on one hand, and the fuel distributor, on the other, is available and used to permit thorough mixing of the auxiliary air with the fuel conveyed.

Clearly, the fuel delivery pump must be capable of developing sufficient pressure to overcome the counterpressure in the bypass line. Preferably the stroke rate of the fuel delivery pump is made as high as possible so as to ensure intimate mixing of the fuel and auxiliary air.

The pressure generator used in the fuel injection system according to the present invention may be a separate, additional compressor which is driven directly by the engine in order to avoid excessive load on the voltage source (battery). If the compressor is actuated by means of the crankshaft or the cam shaft of the engine, it may produce timed pressure variations which result in a timed injection of fuel from the fuel delivery pump into the bypass line. In order to avoid the possibility of troublesome pressure peaks, an intermediate storage chamber may be provided in the bypass line.

In place of a separate compressor, it is also possible to utilize a working chamber of the engine as a pressure generator. This general concept of using a working chamber for the purpose of fuel delivery is disclosed in the German Pat. No. 829,679. In this context, the term "auxiliary air" which is supplied at the outlet of the fuel pump will be understood to include gases and gas mixtures, which may be hot and under high pressure, which are taken from a working chamber. During the compression stroke of the internal combustion engine, this air will be relatively "fresh". However, combustion gases produced during the power stroke may also be used. In the latter case, measures must be taken for cooling the gases and for the prevention of flame propogation. As a rule, a fire grid should be arranged at the point at which the gases emerge from the working chamber.

Depending upon the particular case, the auxiliary air pressure generator may comprise only one working chamber, or several, or even all of the working chambers of the internal combustion engine. In the case of plural working chambers, the respective tap lines to the chambers may be combined in pairs or they may all open individually into the bypass line. In this embodiment of the invention, the fuel delivery pump must be a high pressure pump.

As a basic principle, the utilization of at least one working chamber of the engine as a pressure generator has the advantage of eliminating the requirement for a separate compressor. This arrangement also has an advantage in that the elevated temperature of the auxiliary air enhances the fuel-air mixture preparation in the bypass line.

Clearly, in view of the widely disparate pressures in the various lines and chambers, check valves must be employed in this system according to the present invention, especially between the fuel delivery pump and the bypass line, and in the tap lines at the working chambers of the internal combustion engine.

According to another feature of the present invention, a second intake line may be provided in parallel with the main engine intake line with a second, arbitrarily adjustable throttle flap arranged therein. This second intake line may serve to supply additional air to the engine, when operating conditions warrent. Additional fuel may be provided to the engine in dependence upon the air flow through this second intake line.

This system, which may be employed with or without the arrangement, described above, for supplying auxiliary air at the outlet of the fuel delivery pump, makes it possible to supply air and fuel in different stages for different power ranges of the engine. The system may be used to particular advantage in high-power, high performance engines in which the range of possible loads is very wide. The system may be coordinated in such a manner that the additional air and the additional metered fuel are supplied only in the higher load range of the internal combustion engine. However, it is also possible to have the mechanism providing additional air and fuel remain in operation at all times and for all engine loads so that it functions, in effect, in parallel with the fuel injection apparatus, with the additional air and fuel increasing appropriately as the engine load increases.

In one preferred form of this embodiment, the second, additional intake line is designed as a carburetor which delivers a fuel-air mixture. In another form of this embodiment the additional intake line serves only to deliver the additional air for combustion. In the latter case, the line may be equipped with an air flap which is actuated by the air flow through the line and is in operative connection, for example by means of a mechanical linkage, with a control, such as a needle valve, of the fuel metering device of the fuel injection apparatus. Such an air flap also makes it possible to control the fuel quantity delivered to the diffuser of the carburetor as a function of the air flow through the second intake line.

Still another feature of the present invention makes possible a substantial simplification and a reduction in cost of the fuel injection system. In accordance with this feature, an auxiliary fuel supply device is provided, separate and distinct from the fuel metering device of the injection apparatus, for supplying additional fuel to the engine for idling and/or cold starting operation. A common fuel float chamber is connected to supply fuel both to the fuel metering device and to the auxiliary fuel supply device, thereby eliminating the need for an additional pump or the like for fuel delivery. In this way, a single tank—i.e., a float chamber with a prescribed fuel level—supplies all the fuel delivery devices of the engine merely by using the pressure head established by the float chamber and, possibly, the pressure conditions present within the air channel in the region of the fuel delivery pump inlet.

At this point it should be mentioned that, as described in the aforementioned U.S. patent application Ser. No. 932,943, filing date Aug. 10, 1982, the main supply tube for the fuel should be directed or aimed toward the inlet opening of the fuel delivery pump so that the reaction time of the fuel injection system, in response to changes in the engine load, is as short as possible. It will be understood that air correcting openings may be provided, if necessary, in the main supply tube so as to achieve a desired influence on the metering of fuel. A vent opening may also be provided to prevent the main supply tube from acting as a siphon.

According to another feature of the present invention a device is provided for supplying additional air and fuel during cold starting the warm-up operation of the engine. This device receives additional air from the intake line and supplies a controlled quantity to the intake pipes of the engine. It also receives additional fuel and supplies a controlled quantity to the air channel. A control slide is provided for simultaneously controlling the amount of the additional air and the additional fuel in dependence upon the temperature of the engine.

This cold starting and warm-up device can be conveniently arranged directly next to the intake line at small cost and without the necessity of long connecting lines for air and fuel. This device serves to increase the idling speed in order to overcome the increased frictional forces in a cold engine by supplying to the engine a quantity of air and fuel which is larger than that which would normally be delivered with the throttle valve in the idling position. According to a preferred embodiment, the cold starting and warm-up device is of especially simple construction because it contains only a single slide and an adjustment element which is responsive to the engine temperature—preferably the liquid coolant temperature. This adjustment element moves the slide to regulate the flow cross-section both for the additional air as well as the additional fuel. In this case also, the fuel is supplied at the pressure head developed by the difference in height between the fuel level in the float chamber, on one hand, and the fuel exit opening of the cold starting and warm-up device on the other. Preferably, this fuel exit opening is at the level of the entrance or inlet to the fuel delivery pump; i.e., the lowest possible level.

A particular advantage of this cold starting and warm-up device according to the invention lies in its independence from the actual fuel metering device that supplies fuel to the fuel delivery pump, thus achieving better coordination of the entire mixture preparation system.

As has already been noted, the fuel delivery pump supplies both air as well as fuel in a manner such that the relative proportion of fuel to air increases with increasing power output of the engine. It has been found that it is difficult to seal pump chambers which deliver both fuel as well as air. Therefore, it may be appropriate to shift somewhat in time the delivery of fuel and air, respectively, by the fuel delivery pump. According to a preferred embodiment of the invention, the fuel delivery pump is thus constructed with two separate chambers for the fuel (plus air) and the air. Particular practical configurations of this fuel delivery pump will be described hereinbelow.

Finally, according to still another preferred feature of the present invention, fuel injection apparatus is provided with a device for supplying additional fuel for acceleration of the engine. This fuel may be inserted in the system at a point immediately ahead of the distributor or directly into the intake pipes of the engine.

For a better understanding of the invention, together with other and further objects, reference is made to the following description taken in conjunction with the accompanying drawings, and its scope will be pointed out in the appended claims.

DESCRIPTION OF THE PREFERRED EMBODIMENTS

Figure 1:
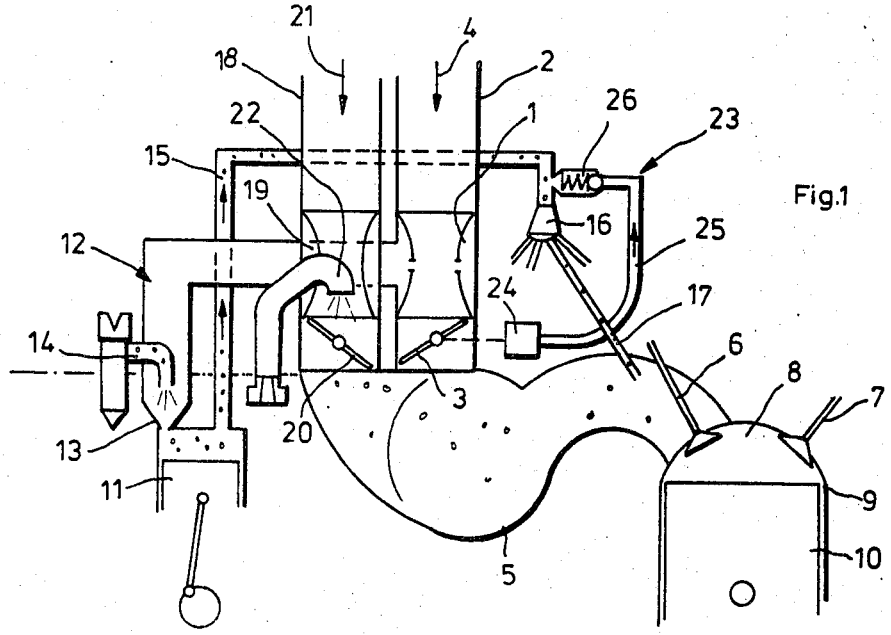
FIG. 1 is a schematic illustration of the fuel injection apparatus according to one preferred embodiment of the present invention comprising a second intake line as a component of a carburetor.

FIG. 1 shows an intake line 2 of a motor vehicle engine provided with a venturi 1 and a throttle valve or flap 3 which can be actuated by the operator of the vehicle by means of a gas pedal. Accordingly, the intake line 2 delivers air 4 for combustion directly into the engine intake pipe 5 as a function of the position of the throttle flap 3. FIG. 1 also shows an intake valve 6 and an exhaust valve 7 for the working chamber 8 of the engine, which is formed in this case by a cylinder 9 and a reciprocating piston 10.

As is also shown in FIG. 1, air is delivered from the region of the venturi 1 over an air channel 12 to a fuel delivery pump 11. The channel 12 is provided with a funnel-shaped constriction 13 or narrowing of its cross-section just ahead of the inlet to the pump 11. The air delivered through the channel 12 serves as auxiliary air for conveying the fuel, delivered through the main supply tube 14, to the individual intake pipes of the engine. In order to ensure fast reaction in case of load change, the discharge opening of the main supply tube 14 is directed or aimed toward the inlet opening of a fuel pump 11. The fuel pump 11 delivers fuel as well as air, over the entire power range of the engine, via the line 15 of the fuel distributor 16. The resulting fuel-air mixture is directed by means of the injection lines 17 to the individual intake pipes 5 of the engine while the combustion air arrives there directly through the intake line 2.

Immediately adjacent to the intake line 2 there is arranged a second, parallel intake line 18 which likewise contains a venturi 19 and an arbitrarily adjustable throttle valve or flap 20. The throttles 3 and 20 are mechanically coupled with each other in such a manner that they open and close together. The intake line 18, which likewise conveys combustion air (indicated by the arrow 21) as a function of the position of the second throttle flap 20, is a component of a carburetor whose fuel diffuser is suggested at 22. This carburetor delivers a fuel-air mixture, directly into the intake pipe 5, which increases as the output of the internal combustion engine increases.

The arrangement shown in FIG. 1 is complemented by an acceleration system 23 having an accelerator pump 24 that is actuated in a conventional manner by means of a cam plate (not illustrated) on the pivot of the throttle flap 3. This acceleration system delivers additional fuel directly ahead of the distributor 16 through a fuel line 25 with a non-return, injection valve 26. By feeding the fuel directly ahead of the distributor 16 the acceleration response time is shortened, in comparison with the time which would be required if the additional fuel were supplied by way of the fuel pump 11 on acceleration. The injection valve 26 is suitably provided with a small clearance or opening directed toward the point of injection. In such a case, the customary accelerator pump discharge check valve may be eliminated.

In this exemplary embodiment, the accelerator pump 24 receives fuel from the float chamber which also serves as the fuel supply for the remaining apparatus. However, it is also possible to construct the acceleration system 23 so that the accelerator pump is supplied directly from the customary fuel pump. In this case, which requires the use of an intake valve at the accelerator pump, the location of the accelerator pump will be independent of the height of the fuel level in the float chamber.

Figure 2:
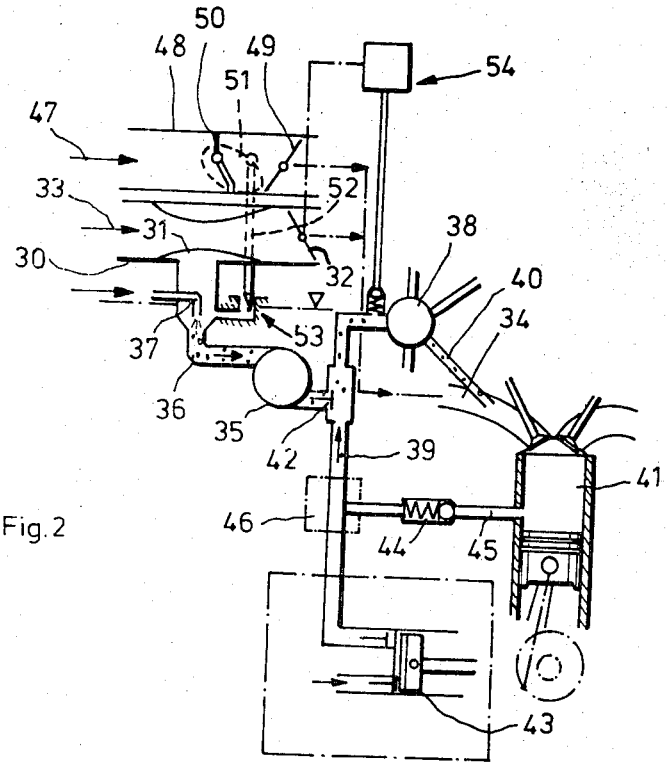
FIG. 2 is a schematic diagram of fuel injection apparatus according to another preferred embodiment of the present invention comprising a second intake line which supplies only additional air for combustion.

Whereas the exemplary embodiment in accordance with FIG. 1 is a multiple-stage device whose second stage is constituted by the carburetor, the embodiment of FIG. 2 is a multiple-stage device in which the second intake line carries only additional air for combustion and no fuel. In this case the intake line 30 constitutes a component of the first stage—i.e., the fuel injection apparatus—with a venturi 31 and an arbitrarily adjustable throttle flap 32 delivering air 33 for combustion into the intake pipe 34. A fuel delivery pump 35 again receives air and fuel from an air channel 36, which branches off from the intake line 30 ahead of the throttle flap 32. The fuel is introduced through a main supply tube 37 and, in this embodiment, is pumped into a bypass line 39 leading to the fuel distributor 38. The injection tubes 40 of the distributor 38, of which only one is shown, lead into the intake pipes 34 which are associated with the working chambers 41 of the engine.

Unlike the embodiment illustrated in FIG. 1, in this embodiment all the auxiliary air is not delivered by way of the fuel pump 35. Rather, only a small part of the auxiliary air is supplied by this pump while the larger part is delivered to the bypass line 39 by an additional pressure generator. The fuel pump 35 may thus be dimensioned so that it is able to supply only the fuel requirements of the internal combustion engine under all conditions of engine load plus a small amount of auxiliary air with sufficient pressure to oppose the pressure in the bypass line 39 through a one-way valve 42. Due to this measure, the fuel pump 35 may be made substantially smaller without the danger, noted above, of forming air pockets in the portion of the bypass line 39 extending between the pump 35 and the distributor 38. The pressure generator is preferably dimensioned to deliver a sufficient quantity of auxiliary air, relative to the fuel quantity, such that the fuel initially precipitates on the walls of the bypass line 39 and is taken along by the auxiliary air in a finely divided mist.

FIG. 2 illustrates two possibilities for realizing the additional pressure generator. First, the auxiliary air may be supplied by a separate, additional compressor 43 which is driven directly by the internal combustion engine so that it does not constitute a load on the engine battery. However, it is also possible to take the auxiliary air from one or more working chambers 41 of the engine by means of a line 45 equipped with a one-way valve 44. In this case, additional measures must be taken to ensure that pressure is tapped only during defined periods of the working cycle of the engine or, in the alternative, to suppress flame propogation from each working chamber 41.

In order to reduce unwanted pressure fluctuations in the bypass line 39, an intermediate reservoir 46 may be provided.

Combustion air (arrows 33 and 47) is delivered to the intake pipes 34 directly through the main intake line 30 and the second, auxiliary intake line 48. In addition to the conventional throttle flap 49, the auxiliary intake line also contains another air flap 50 which is pivoted to permit it to rotate to an angular position which is a function of the air through this intake line 48. This angular position is used to adjust a nozzle needle 52 of a jet needle valve 53 of the fuel metering device by means of a cam 51. As in the case of the system shown in FIG. 1 therefore, the delivery of additional fuel and combustion air to the intake pipe 34—and of course also to the other intake pipes of the engine—is thus achieved in this system as a function of the fuel and air requirements (i.e., load) of the internal combustion engine.

As in the system shown in FIG. 1, this system of FIG. 2 also includes an acceleration unit 54 which, on acceleration of the engine, injects additional fuel into the bypass line 39 directly ahead of the distributor 38.

Figures 3, 4:
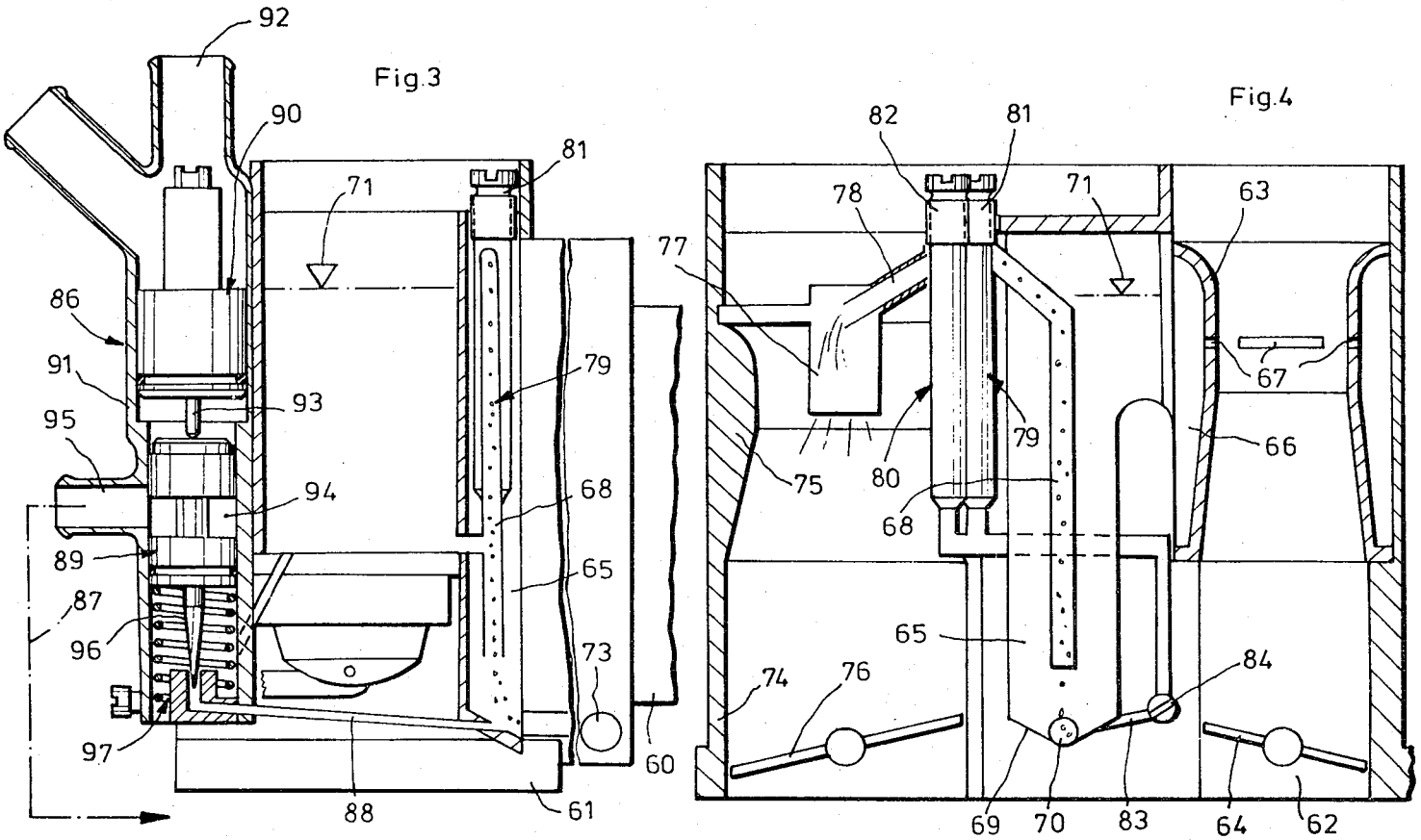
FIGS. 3, 4 and 5 are cross-sectional views through a portion of fuel injection apparatus according to the present invention in which the second intake line forms a component of a carburetor.
Figure 5:
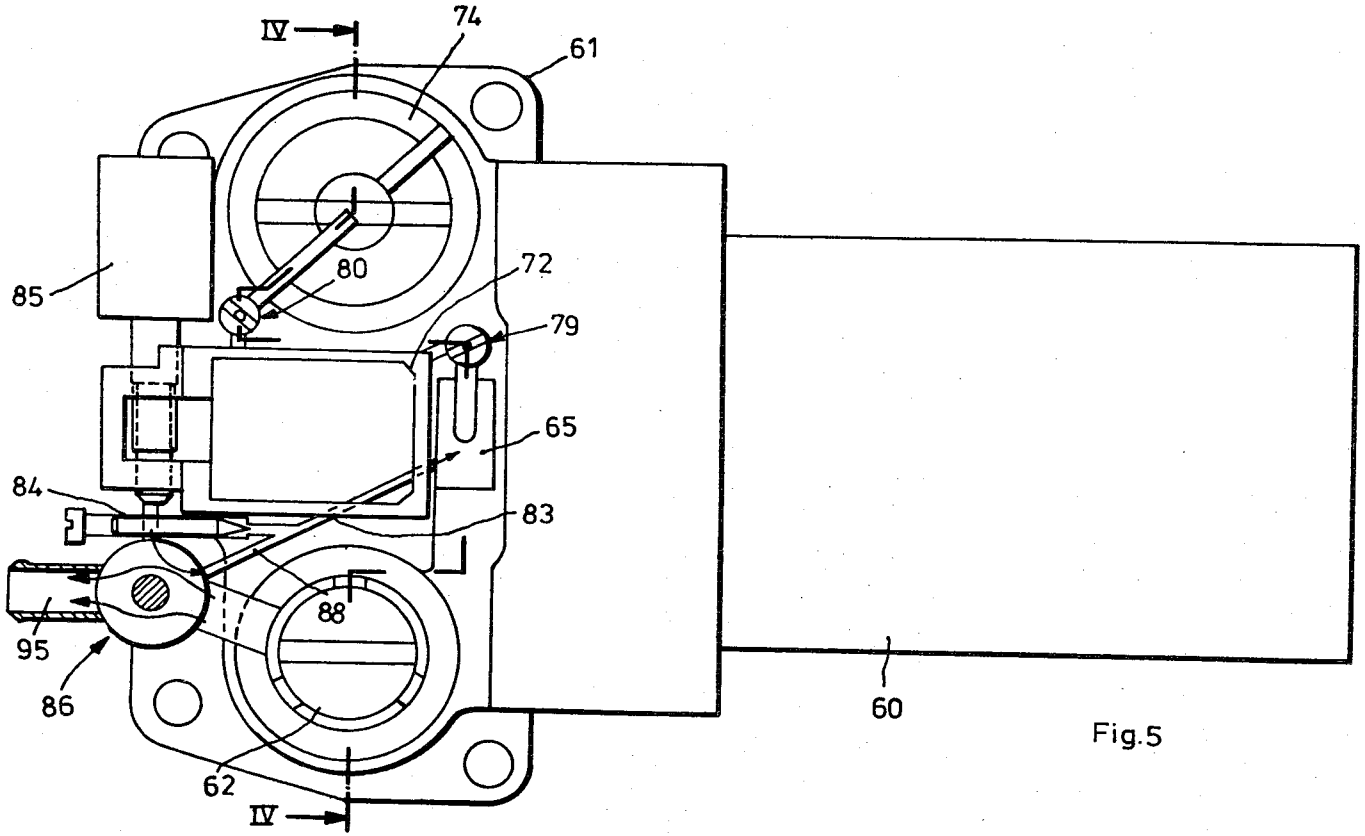

Considering now FIGS. 3, 4 and 5, FIG. 3 shows a vertical center section through a multi-stage system having a carburetor as a second stage; FIG. 4 illustrates the section designated by IV—IV in FIG. 3.

FIGS. 3 and 5, show a fuel delivery pump 60 which supplies both fuel and auxiliary air within the entire power range of the internal combustion engine. Together with the other parts of the system this pump forms a single component that can be fixed to the engine by means of the flange 61.

A first intake line 62 constitutes a part of the first stage of this multi-stage system, as shown in FIG. 4, again with a venturi 63 within a region which branches off to an air channel 65 ahead of an arbitrarily adjustable throttle flap 64. Towards this end, the venturi 63 is provided with the annular chamber 66 which is in communication with the interior of the intake line 62 by means of uniformly distributed slits 67.

At the bottom portion of the channel 65, which extends substantially vertically and into which projects the main supply tube 68 for the fuel, there is located the funnel-shaped constriction or narrowed cross section 69 and a suction line 70 leading to the inlet of the fuel pump 60. Because of the difference in height between the point 70, and the fuel level designated by 71 in the float chamber 72 (FIG. 5), no additional means are required for the delivery of the fuel.

The fuel plus auxiliary air conveyed by the fuel delivery pump 60 proceeds through the outlet 73 of the pump (FIG. 3) to the fuel distributor 16 (FIG. 1).

The system in accordance with FIGS. 3, 4 and 5 also includes a second, additional intake line 74 which again contains a venturi 75 and an arbitrarily adjustable throttle flap 76. Movement of the throttle flap 76 is linked mechanically to that of the throttle flap 64 so that both flaps open and close together. A fuel diffuser 77 is arranged in the second intake line 74, in the upper zone of the venturi 75, and is provided with fuel through a line 78, likewise from the float chamber 72. Accordingly, the "second stage" of the system, with its components 74–78, forms a carburetor capable of delivering a fuel-air mixture to the intake pipes of the engine.

Delivery of fuel to the main supply pipe 68 and to the diffuser 77 is effected by means of mixing tubes 79 and 80. Additional air is introduced to these tubes at 81 and 82 in a conventional manner.

Opening into the bottom of the air channel 65 is a fuel line 83 to which is connected and idling system as well as a cold-starting and warming-up system. The idling system contains a needle nozzle valve 84 for adjustment of the idling fuel quantity which is constant over the entire power range of the engine, apart from the influence of the control pressure in the lower region of the channel 65. The communication of the line 83 with the float chamber 72 can be interrupted by means of a blocking valve 85 that may be actuated electrically or pneumatically.

The cold-starting and warming-up system 86 is placed in parallel with the two intake lines 62 and 74. When the engine is cold, it serves to deliver additional air through a line 87 leading into the intake pipes and additional fuel through a line 88 opening into the line 83. The main components of the system 86 are a control slide valve 89, designed as a piston, and an expansion-type temperature-responsive element 90. The slide valve 89 and the temperature-responsive element 90 are both arranged in a cylinder 91 with the element 90 being fixed to expand in the direction of the axis of the cylinder. The element 90 is placed in a flow path 92 of the cooling water of the internal combustion engine and moves the piston 89 by means of its tappet 93. The piston has an annular groove 94 which, together with the edge of the outlet opening 95 in the cylinder 89, changes the flow cross section for the additional air. Similarly, a nozzle needle of a needle valve 97 maintained on the front end of the piston 89, varies the flow cross section for the additional fuel through the line 88.

As may be seen, all systems to be supplied with fuel are so supplied without any additional fuel delivery device, merely by utilization of the pressure head from one and the same float chamber 72.

Figure 7:
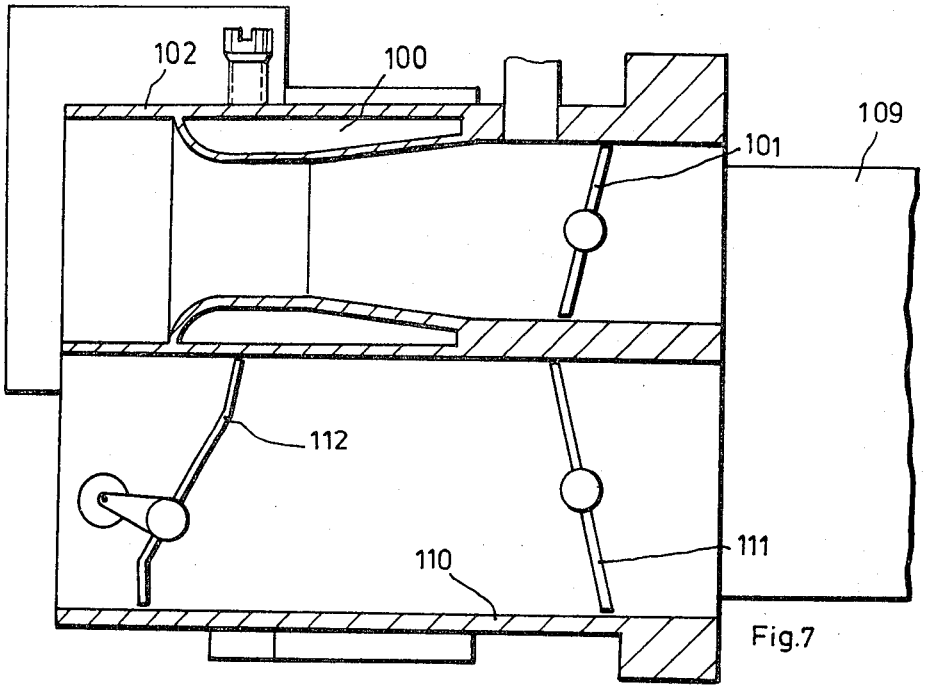
FIGS. 7, 8 and 9 are cross-sectional views through a portion of fuel injection apparatus according to the present invention in which the second intake line supplies only air for combustion.
Figure 8:
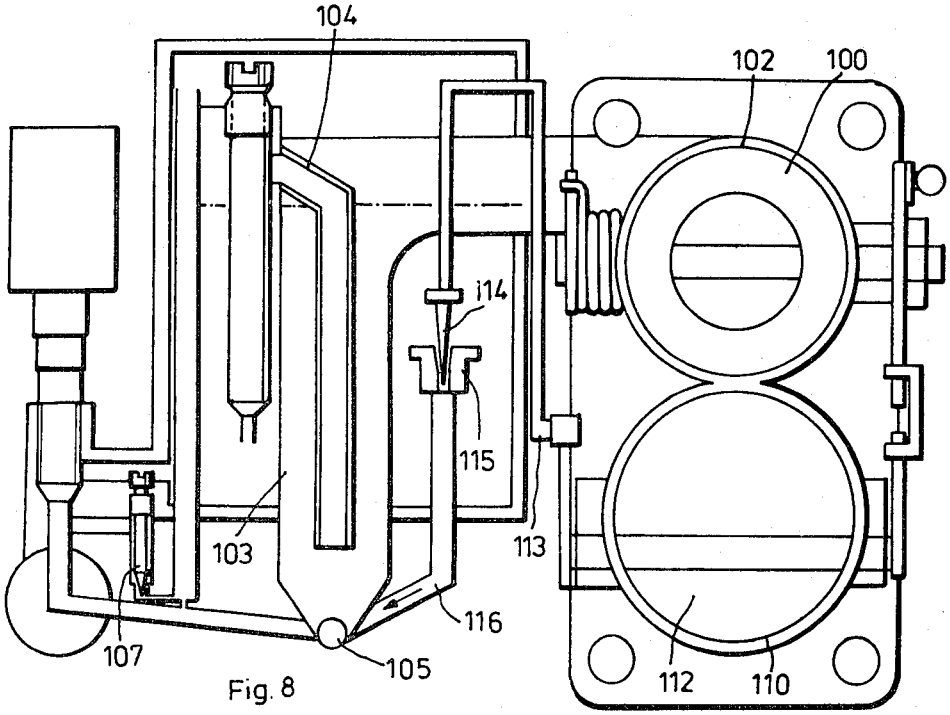
Figure 9:
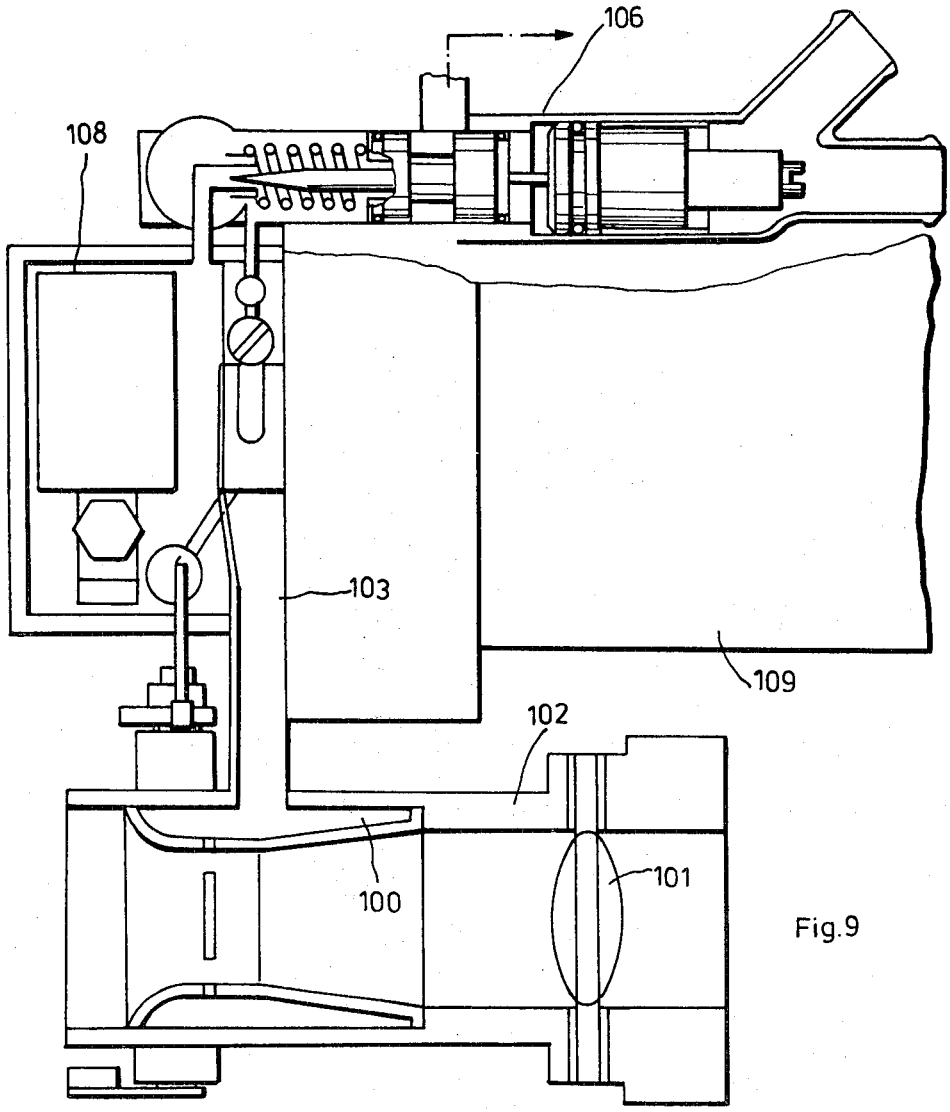

This also applies to the embodiment of the invention in accordance with FIGS. 7, 8 and 9 which show three perpendicular cross sections. This embodiment includes an intake line 102, provided with a venturi 100 and the arbitrarily adjustable throttle flap 101. The intake line 102 is in communication, ahead of the throttle flap 101 (as seen in the direction of flow), with an air channel 104 for the fuel. In the region of the lowest point of the channel 103 there is an outlet opening and, respectively, an inlet port 105 to the delivery pump for fuel and air. The fuel supply to all the systems, including a cold starting and warming up system 106 and an idling system 107, is again effected by utilization of the pressure head from a single float chamber 108. The fuel delivery pump is indicated by the block 109. In contrast to the previously described embodiment of the invention, the second intake line 110 in this embodiment does not constitute a component of a carburetor. Rather, it contains an air flap 112 arranged ahead of another arbitrarily adjustable throttle flap 111. This flap 112 is pivoted in such a way that it assumes various positions as a function of the air throughput through the second intake line 110. In this case the second intake line 110 supplies only additional air for combustion in the engine.

As shown in FIG. 8, angular movements of the air flap 112 are converted by means of a rod linkage 113 into longitudinal movements of a nozzle needle 114 of a needle jet valve 115. This valve 115 controls the fuel flow through an additional fuel line 116 which again opens into the channel 103 at its lower extremity. Accordingly, a controlled quantity of additional fuel is supplied in this embodiment by means of the fuel delivery pump 109.

In case of both the above-described embodiments in accordance with the invention (FIGS. 3-5 and FIGS. 7-9), additional fuel and air are supplied to the engine only in case of higher engine outputs. It is also possible, however, to adjust the systems in such a manner that the additional fuel and air are supplied in all load ranges in increasing proportion as the engine output increases.

Figure 6:
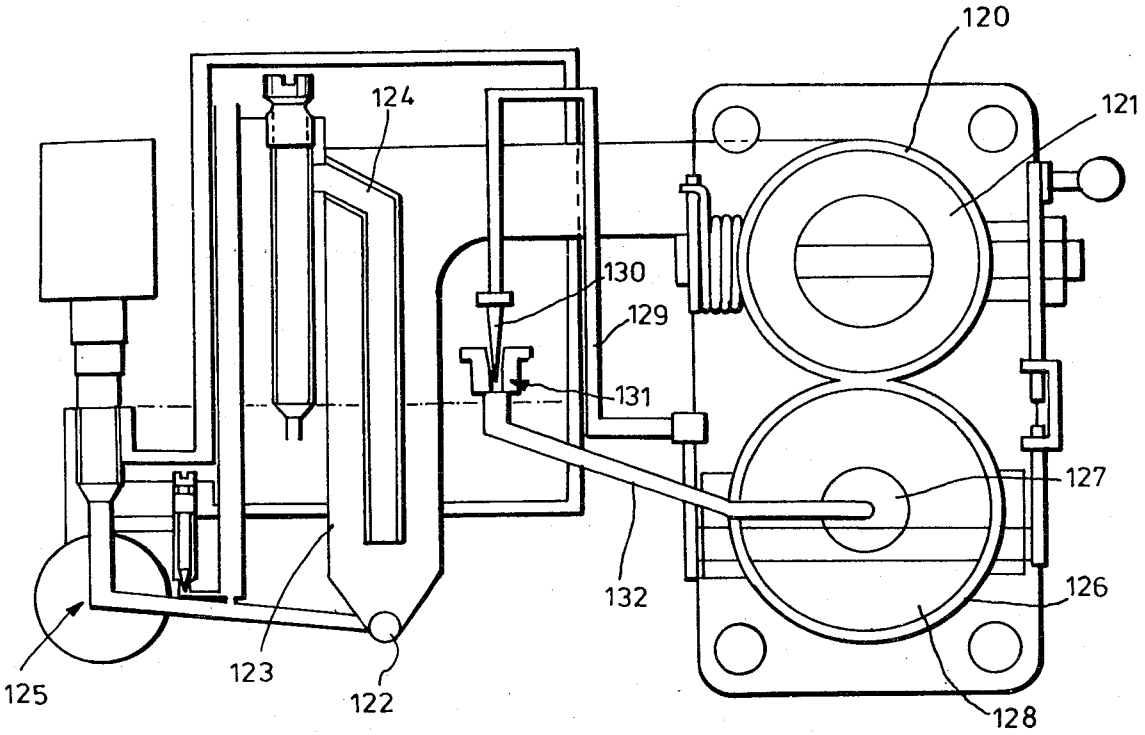
FIG. 6 is a cross-sectional view through a portion of fuel injection apparatus according to the present invention which includes an additional carburetor.

FIG. 6 shows a cross section through another system in which the second stage is constituted by a carburetor. This embodiment includes a first intake line 120 with its venturi 121 and an air channel 123 branching off it and leading to the inlet side 122 of a fuel delivery pump, not shown. A main fuel supply tube 124 projects into the channel 123 in the customary manner. The part of the device generally designated by 125 contains the aforementioned idling and cold-start systems.

A second intake line 126 contains both a carburetor diffuser 127 and an air flap 128 whose angular position is a function of the combustion air throughput in the intake line 126. The needle 130 of a jet needle valve 131 is moved by a rod linkage 129, responsive to the position of the air flap 128, and controls the quantity of fuel passed through a fuel delivery line 132 to the diffuser 127.

Figure 10:
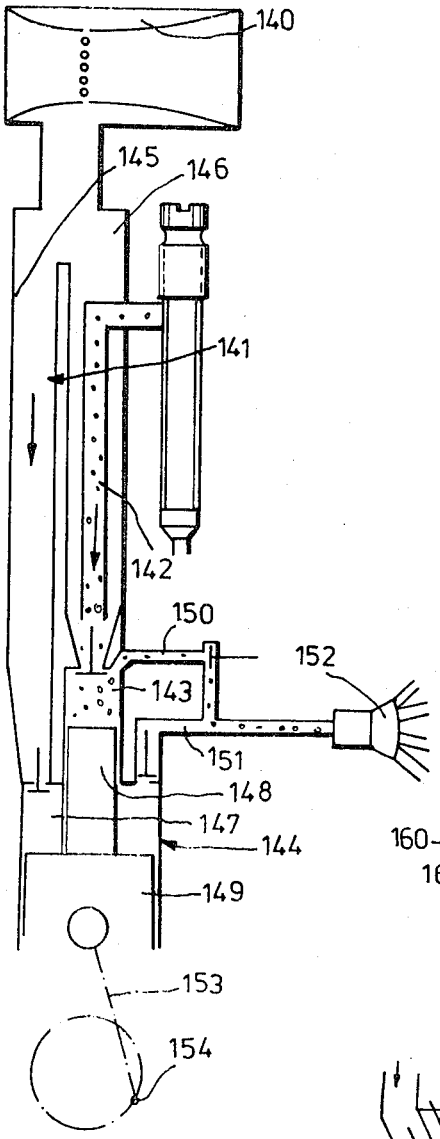
FIGS. 10, 11 and 12 are schematic diagrams showing, respectively, three preferred embodiments of a fuel delivery pump which may be used with the fuel injection apparatus according to the present invention.
Figure 11:
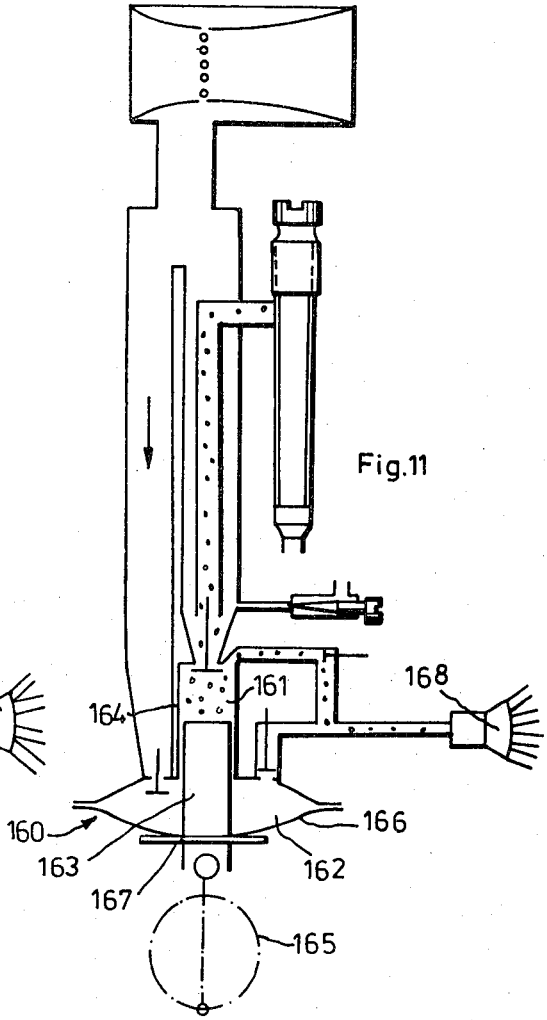
Figure 12:
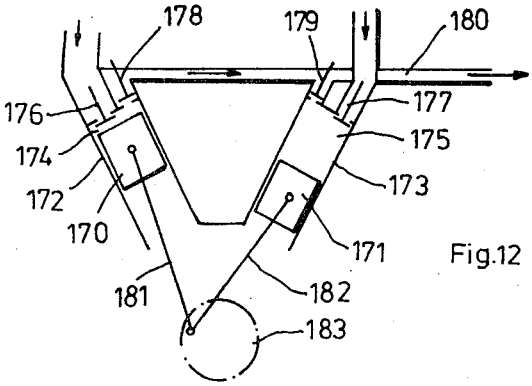

FIGS. 10, 11 and 12 illustrate cross sections—FIG. 12 in skeleton form—through fuel delivery pumps of various advantageous constructions. In the embodiment shown in FIG. 10, the lower end of the air channel 141, which is in communication with a venturi 140 of a first intake line and into which projects the main fuel supply tube 142, opens into the first chamber 143 of a double-piston fuel delivery pump generally designated by 144. In this embodiment the air channel 141 is divided into two branches, 145 and 146, of which only one branch 146 carries fuel, whereas the other branch 145 serves to deliver auxiliary air to the second chamber 147 of the fuel delivery pump 144. The pump contains a stepped piston with two piston zones: 148 with a smaller diameter and 149 with a larger diameter, each of which determines the volume of one of the chambers 143 and 147. When the piston develops sufficiently high pressure, the chambers 143 and 147 communicate by means of valves in some suitable arrangement with intake lines 150 and 151 which are joined together ahead of a fuel distributor 152. The distributor 152 is connected on its outlet side with the engine intake pipes, not shown.

As is evident from FIG. 10, it is possible to construct pump chambers of widely varying size with the single stepped piston 148, 149. This piston is driven by means of a piston rod 153 articulated eccentrically at 154 on a shaft, which is rotated by the internal combustion engine.

The general construction of the system in FIG. 11 is similar to the one in FIG. 10, except for the fuel delivery pump 160, so that only the pump will be described. Here again, the pump contains separate chambers 161 and 162 for fuel and air. The chamber 161 is also located at the end of a piston 163 which passes through the other chamber 162 thereby forming an annular chamber. The piston is retained in the cylinder 164 notwithstanding the transverse forces which the drive 165 exerts on it.

An annular diaphragm 166 constitutes a wall of the other chamber 162. The central portion of the diaphragm is fixed on the piston 163, forming an air-tight seal. Thus, by means of the movement of a single piston, the volumes of both chambers 161 and 162 can be changed together, thereby delivering fuel and air simultaneously to the distributor 168.

Finally, a third possible embodiment of the fuel delivery pump is shown in FIG. 12. In this case, the pump is a double-piston pump which may be a V-type or a horizontally opposed (pancake) type. Two pistons 170 and 171 are shown sliding in their respective cylinders 172 and 173. Together with upper end walls in the cylinders which are equipped with valves, those pistons form chambers 174 and 175 of differing size. During downward motion of the respective pistons 170 and 171, the chambers 174 and 175 are in communication through intake valves 176 and 177 with the air channel (designated by 141 in FIG. 10) whereas on upward motion of the pistons, they deliver fuel and air through valves 178 and 179, respectively, into the line 180 leading to the fuel distributor (not shown).

The drive for the two pistons is effected by piston rods 180 and 181 that are articulated on a rotating eccentric disk 183. By separately articulating the piston rods 181 and 182 on the eccentric disk 83, and also by suitably arranging the two cylinders 172 and 173 with respect to each other and with respect to the eccentric disk 183, it becomes possible to select the timing of the moments in which volumes of the chambers 174 and 175 are decreased and, thus, of the moments in which fuel and air are delivered to the distributor. Clearly, the size of the chambers may also be selected to suit the particular fuel and air requirements of the engine.

It will be understood that the various measures described above may be advantageously combined to form other practical embodiments.

In order to ensure that the acceleration system delivers fuel at the precise time, with respect to the time of arrival of fuel and air delivered by the fuel pump, it may be advantageous to supply the additional fuel directly into the intake pipes of the engine. In this case, the accelerator pump may be arranged to deliver the fuel to a chamber to which are connected separate injection lines branching off to the individual intake pipes.

While there have been described what are believed to be the preferred embodiments of the invention, those skilled in the art will recognize that various changes and modifications may be made thereto without departing from the spirit of the invention, and it is intended to claim all such embodiments as fall within the true scope of the invention.

We claim:

1. Apparatus for injecting fuel into the intake pipes of an internal combustion engine, said engine having an intake line for conducting air to said intake pipes with an arbitrarily adjustable throttle flap arranged therein, said fuel injection apparatus comprising, in combination:

(a) an air channel branching off from said intake line at a point ahead of said throttle flap, as viewed in the direction of air flow through said intake line, and having at its opposite end a narrowed cross section;

(b) fuel metering means for supplying fuel to said air channel in dependence upon engine load;

(c) a fuel distributor and means, connected to said distributor, for supplying a fuel-air mixture to the individual intake pipes of the engine;

(d) a fuel delivery pump connected between said narrowed cross section of said air channel and said distributor for supplying fuel and air to said distributor;

(e) auxiliary fuel supply means for supplying additional fuel to said engine for idling and/or cold starting operation; and (f) a fuel float chamber connected to supply fuel both to said fuel metering means and to said auxiliary fuel supply means, the fuel level in said floatchamber being arrested at a height with respect to said auxiliary fuel supply means that the fuel pressure head is sufficient to ensure a proper fuel supply thereto.

2. The fuel injection apparatus recited in claim 1, further comprising means for supplying auxiliary air at said fuel delivery pump for forming a fuel-air mixture to be supplied to said distributor.

3. The fuel injection apparatus recited in claim 2, wherein said air channel extends substantially vertically at least at the portion thereof immediately preceding said fuel delivery pump, and wherein said air channel opens into said fuel delivery pump in the region of its lower end.

4. Apparatus for injecting fuel into the intake pipes of an internal combustion engine, said engine having an intake line for conducting air to said intake pipes with an arbitrarily adjustable throttle flap arranged therein, said fuel injection apparatus comprising, in combination:

(a) an air channel branching off from said intake line at a point ahead of said throttle flap, as viewed in the direction of air flow through said intake line, and having at its opposite end a narrowed cross section;

(b) fuel metering means for supplying fuel to said air channel in dependence upon engine load;

(c) a fuel distributor and means, connected to said distributor, for supplying a fuel-air mixture to the individual intake pipes of the engine;

(d) a fuel delivery pump connected between said narrowed cross section of said air channel and said distributor for supplying fuel and air to said distributor;

(e) means for supplying additional air and fuel during cold starting and warm-up operation of the engine including:

(1) means, receiving additional air from said intake line, for supplying said additional air to said intake pipes of the engine;

(2) means for supplying additional fuel to said air channel; and (3) control means, responsive to a temperature of said engine, for simultaneously controlling the amount of said additional air and said additional fuel.

5. The fuel injection apparatus recited in claim 4, wherein said control means includes a control slide for varying the flow cross section for said additional air and the flow cross section for said additional fuel.

6. The fuel injection apparatus recited in claim 4, further comprising means for supplying auxiliary air at said fuel delivery pump for forming a fuel-air mixture to be supplied to said distributor.

7. The fuel injection apparatus recited in claim 1, wherein said means for supplying additional air and fuel during cold starting and warm-up operation further include a temperature sensor arranged in the flow path of a liquid coolant of the engine.

8. The fuel injection apparatus recited in claim 7, wherein said temperature sensor is an expansion element.

9. The fuel injection apparatus recited in claim 5, wherein said control slide is a piston arranged to move within a cylinder, said piston having a circumferential groove cooperating with an opening in said cylinder determining the flow cross section for said additional air, the end of said piston forming a component of a needle valve determining the flow cross section for said additional fuel.

* * * * *

UNITED STATES PATENT AND TRADEMARK OFFICE

CERTIFICATE OF CORRECTION

PATENT NO. : 4,363,308

DATED : December 14, 1982

INVENTOR(S) : Emmenthal et al.

It is certified that error appears in the above-identified patent and that said Letters Patent is hereby corrected as shown below:

Column 4, line 14, "1982" should read --1978--;
Column 9, line 68 and column 10, line 1, "etermines" should read --determines--;
Column 10, line 49, "83" should read --183--;
Column 11, line 36, "arrested" should read --arranged--;
Column 11, line 44, "claim 2" should read --claim 1--; and
Column 12, line 37, "claim 1" should read -- claim 4--.

Signed and Sealed this

*Eighth* Day of *March 1983*

[SEAL]

*Attest:*

GERALD J. MOSSINGHOFF

*Attesting Officer*

*Commissioner of Patents and Trademarks*